US005174955A

United States Patent [19]

Shioda et al.

[11] Patent Number: 5,174,955

[45] Date of Patent: Dec. 29, 1992

[54] HEAT-RESISTING ALUMINUM ALLOY

[75] Inventors: Masahiko Shioda, Yokohama; Syunsuke Suzuki, Tokyo; Akira Matsuyama, Zushi; Yoshihiro Maki, Miura, all of Japan

[73] Assignee: Nissan Motor Co., Ltd., Yokohama, Japan

[21] Appl. No.: 885,758

[22] Filed: Jul. 22, 1986

Related U.S. Application Data

[63] Continuation of Ser. No. 636,481, Jul. 31, 1984.

[30] Foreign Application Priority Data

Aug. 17, 1983 [JP] Japan ..... 58-149161

[51] Int. Cl.[5] ..... C22C 27/04; B22F 9/00

[52] U.S. Cl. ..... 420/529; 75/249; 75/352; 148/438; 419/66; 419/67; 420/538

[58] Field of Search ..... 420/529, 538; 419/66-69; 148/438; 75/0.5 C, 249, 352

[56] References Cited

U.S. PATENT DOCUMENTS

| | | | |
|---|---|---|---|
| 2,966,731 | 1/1961 | Towner | 75/249 |
| 3,004,331 | 10/1961 | Towner et al. | 420/529 |
| 3,265,493 | 8/1966 | Foerster | 75/249 |
| 3,462,248 | 8/1969 | Roberts | 75/249 |

FOREIGN PATENT DOCUMENTS

| | | |
|---|---|---|
| 1370542 | 7/1964 | France . |
| 498227 | 1/1939 | United Kingdom . |

*Primary Examiner*—R. Dean
*Assistant Examiner*—Robert R. Koehler
*Attorney, Agent, or Firm*—Foley & Lardner

[57] ABSTRACT

A heat-resisting aluminum alloy contains manganese ranging from 6 to 8% by weight, iron ranging from 0.5 to 2% by weight, zirconium ranging from 0.03 to 0.5% by weight, and copper ranging from 2 to 5% by weight, the balance being essentially aluminum. The aluminum alloy has been confirmed to be high in mechanical strength both at ordinary temperatures and at high temperatures while to be suitable for producing an article by using so-called atomization process.

9 Claims, No Drawings

HEAT-RESISTING ALUMINUM ALLOY

This application is a continuation of application Ser. No. 636,481, filed Jul. 31, 1984, abandoned.

BACKGROUND OF THE INVENTION

1. Field of the Invention

This invention relates, in general, to a heat-resisting aluminum alloy which is high in mechanical strength not only at ordinary temperatures but also at high temperatures, and more particularly to the heat-resisting aluminum alloy suitable for the material of automotive engine component parts subjected to ordinary to high temperatures.

2. Description of the Prior Art

It is a recent tendency that improved fuel economy has been eagerly desired particularly in the field of automotive vehicles. As a measure for attaining the improved fuel economy, weight reduction of the automotive vehicles has been made by using light weight component parts made, for example, of aluminum alloy. Thus, aluminum alloy has been extensively used as the material of the automotive vehicle component parts, particularly of engine component parts.

However, it is difficult to employ usual aluminum alloy for the material of the engine component parts which are required to have a high mechanical strength throughout a wide temperature range from normal temperatures to about 250° C.

More specifically, so-called high strength aluminum alloy such as one whose designation number is 7075 has a good strength characteristics at normal temperatures but is sharply lowered in strength in a temperature range from normal temperatures to 200° C. In this regard, such high strength aluminum alloy is not suitable for the material of the component parts of automotive engines. The designation numbers of aluminum alloys mentioned hereinabove and hereinafter are adopted by the Aluminum Association in the United States of America.

Regarding so-called heat-resisting aluminum alloy such as one whose designation number is 2218, it is excellent in strength at high temperatures but is lower in strength at normal temperatures. As a result, such heat-resisting aluminum alloy is also not suitable for the material of automotive engine component parts.

SUMMARY OF THE INVENTION

A heat-resisting aluminum alloy according to the present invention contains manganese ranging from 6 to 8% by weight, iron ranging from 0.5 to 2% by weight, zirconium ranging from 0.03 to 0.5% by weight, and copper ranging from 2 to 5% by weight. The balance is essentially aluminum. By virtue particularly of the lowered upper limit of content of manganese and iron and the increased content of copper, the aluminum alloy becomes high both in strength at ordinary and high temperatures and becomes suitable for the material of an article produced by using so-called atomization process in which molten metal of the parent metal is sprayed to obtain powder particles which will be finally compression-formed into a desired article.

DESCRIPTION OF THE INVENTION

According to the present invention, a heat-resisting aluminum alloy comprises manganese ranging from 6 to 8% by weight, iron ranging from 0.5 to 2% by weight, zirconium ranging from 0.03 to 0.5, copper ranging from 2 to 5% by weight, and the balance essentially aluminum in which the balance may include impurities. In this aluminum alloy, the upper limit of the added amount or content of manganese (Mn) and iron (Fe) is kept lower thereby to suppress cystallization of bulky phase and segregation of Mn compound, while increasing the added amount or content of copper (Cu) which is an additive element for improving mechanical strength throughout a wide temperature range from ordinary temperatures to about 250° C. without affecting Mn compound. This make possible to obtain the heat-resisting aluminum which is high in mechanical strength both at ordinary temperatures and high temperatures without using quench solidification such as so-called splat cooling process which will complicate production processes thereafter.

The above-stated range of content of the components of the heat-resisting aluminum alloy of the present invention has been limited for the reasons discussed hereinafter.

Mn:6 to 8% by weight.

Mn is an element effective for improving heat resistance and wear resistance of aluminum alloy. However, if the content of Mn is less than 6%, sufficient heat resistance cannot be obtained, while if it exceeds 8%, there occurs crystallization of the bulky phase and segregation of Mn compound at the cooling rate obtained by the atomization process. As a result, the content of Mn has been limited within the range from 6 to 8% by weight.

Fe:0.5 to 2% by weight.

Fe is an element effective for improving high temperature stability of supersaturated solid solution (obtained by quenching) of Al-Mn alloy and fine Al-Mn intermetallic compound. However, if the content of Fe is less than 0.5%, such an effect cannot be obtained, while if it exceeds 2%, brittle phase of Al-Mn-Fe and Al-Fe is crystallized in the atomization process. As a result, the content of Fe has been limited within the range from 0.5 to 2% by weight.

Zr:0.03 to 0.5% by weight.

Zr is an element effective for making fine crystal particles in addition for improving high temperature stability of supersaturated solid solution of Al-Mn alloy and fine Al-Mn intermetallic compound. However, the content of Zr is less than 0.03%, such an effect cannot be obtained, while if it exceeds 0.5%, there occurs enlargement of Al-Zr phase. As a result, the content of Zr has been limited within the range from 0.03 to 0.5% by weight.

Cu:2 to 5% by weight.

Cu is an element which is effective for improving mechanical strength at ordinary temperatures and by which the heat-resisting aluminum alloy according to the present invention is most characterized. In other words, the present invention is intended to improve the mechanical strength in a wide temperature range from ordinary temperatures to 250° C. without affecting Mn compound, by increasing the content of Cu in order to compensate a decrease of Mn, Fe content which decrease is made for the purpose of suppressing coarsening and segregation of Mn compound in powder form produced by the atomization process. It will be noted that if the content of Cu is less than 2%, the effect of strength improvement cannot be expected, while if it exceeds 5%, corrosion resistance of the aluminum alloy is degraded, accompanied by deteriorating the high temperature stability of the supersaturated solid solution of Al-Mn alloy and very fine Al-Mn intermetallic compound. As a result, the content of Cu has been limited within the range from 2 to 5% by weight.

Now, addition of silicon (Si) and magnesium (Mg) other than Cu is thinkable. However, if Si is added in a corresponding amount aiming the same degree strength improvement as in the case of Cu addition, Si is unavoidably contained in the form of α-Al(Fe,Mn)Si phase in Mn compound and therefore is less than Cu in strength improvement effect due to solid solution hardening and precipitation hardening.

Mg is an element which improves mechanical strength at ordinary temperatures by age hardening upon binding of Mg with Si. However, as stated above, Si tends to take the form α-Al(Fe,Mn)Si phase and therefore the strength improvement due to the precipitation of $Mg_2Si$ phase is degraded as compared with that due to Cu addition.

In order to evaluate the heat-resisting aluminum alloy according to the present invention, Examples (Sample Nos. 1 to 5) of the present invention will be discussed hereinafter in comparison with Comparative Examples (Sample Nos. 6 to 12) which are out of the scope of the present invention. The chemical compositions of the Examples and Comparative Examples are shown in Table 1.

TABLE 1

| | Chemical Composition (Wt. %) | | | | | | | | | |
|---|---|---|---|---|---|---|---|---|---|---|
| No. | Mn | Fe | Ni | Zr | Cu | Mg | Zn | Cr | Al and impurities | Reference |
| 1 | 6.5 | 1.5 | — | 0.1 | 3.5 | — | — | — | balance | Examples (Present Invention) |
| 2 | 6.5 | 1.5 | — | 0.1 | 5.0 | — | — | — | balance | |
| 3 | 7.0 | 2.0 | — | 0.15 | 4.0 | — | — | — | balance | |
| 4 | 8.0 | 1.0 | — | 0.1 | 2.5 | — | — | — | balance | |
| 5 | 8.0 | 1.5 | — | 0.05 | 4.0 | — | — | — | balance | |
| 6 | — | — | 2.0 | — | 4.0 | 1.5 | — | — | balance | Comparative Examples |
| 7 | — | — | — | — | 2.0 | 2.5 | 5.6 | 0.3 | balance | |
| 8 | 5.0 | 1.0 | — | 0.1 | 2.0 | — | — | — | balance | |
| 9 | 4.0 | 0.5 | — | 0.05 | 3.5 | — | — | — | balance | |
| 10 | 8.5 | 2.5 | — | 0.15 | — | — | — | — | balance | |
| 11 | 8.5 | 2.5 | — | 0.15 | 2.5 | — | — | — | balance | |
| 12 | 9.0 | 1.5 | — | 0.2 | — | — | — | — | balance | |

The aluminum alloys of Sample Nos. 1 to 5 and of Sample Nos. 8 to 12 were prepared as follows: A binary alloy ingot containing Al and an individual component other than Al, and an Al ingot were weighed and molten to be mixed with each other thereby to produce a parent metal having a chemical composition shown in Table 1. Thereafter, the patent metal was molten in a melting furnace of an atomizing device, and the thus prepared molten metal was sprayed upon being superheated 150° C. over the melting point of the parent metal, thereby obtaining atomized powder. The atomized powder having a particle size not larger than 120 mesh was used for preparing a specimen subjected to tests discussed below. Subsequently, the atomized powder was formed into a cylindrical shape under the compression of 3.5 tonf/cm$^2$ to obtain a billet. The billet was then subjected to an extrusion process at a temperature lower than 400° C. and at an extrusion ratio (the ratio between the cross-sectional areas of the billet and an extruded product) of 12:1. The extruded product was cut out into a predetermined shape to obtain the specimen for the tests.

The Sample Nos. 6 and 7 correspond to aluminum alloys whose designation numbers are 2218 and 7075, respectively. These were prepared as follows: The molten metal of the parent metal corresponding to each Sample No. was formed into an ingot for rolling which ingot thereafter underwent hot rolling. Subsequently, a product corresponding to Sample No. 6 was subjected to solid solution treatment at 510° C. for 4 hours and to artificial aging treatment at 175° C. for 4 hours, whereas a product corresponding to Sample No. 7 was subjected to solid solution treatment at 460° C. for 4 hours and to artificial aging treatment at 120° C. for 24 hours. Thereafter, each product were cut out into the predetermined shape to obtain each specimen for the tests.

Next, a tension test was conducted on each of the thus obtained specimens at an ordinary (or room) temperature and at 200° C., in which tension value measurement in test at 200° C. was made after each specimen had been kept heated for 1 hour. The test result is shown in Table 2 in which Sample Nos. correspond to those in Table 1.

TABLE 2

| | Strength at room temp. | | Strength at 200° C. | | |
|---|---|---|---|---|---|
| Sample No. | tensile strength (kgf/mm$^2$) | yield strength (kgf/mm$^2$) | tensile strength (kgf/mm$^2$) | yield strength (kgf/mm$^2$) | Reference |
| 1 | 54.3 | 45.7 | 42.7 | 34.2 | Examples (Present Invention) |
| 2 | 57.7 | 48.9 | 40.9 | 34.6 | |
| 3 | 57.4 | 48.9 | 43.1 | 35.7 | |
| 4 | 55.1 | 46.3 | 44.3 | 37.3 | |
| 5 | 59.8 | 49.1 | 40.3 | 35.9 | |
| 6 | 41.0 | 30.5 | 32.6 | 27.5 | Comparative Examples |
| 7 | 55.1 | 48.5 | 24.7 | 22.3 | |
| 8 | 44.9 | 35.8 | 30.6 | 25.3 | |
| 9 | 47.0 | 37.8 | 29.8 | 21.8 | |
| 10 | 45.3 | 35.8 | 41.5 | 32.7 | |
| 11 | 46.1 | 37.3 | 40.1 | 32.6 | |
| 12 | 39.7 | 32.4 | 37.4 | 31.7 | |

As shown in Table 2, all the Sample Nos. 1 to 5 aluminum alloys according to the present invention exhibit considerably higher tensile strengths at ordinary temperatures and at 200° C. than the designation number 2218 heat-resisting aluminum alloy (Sample No. 6). Particularly, the strength at ordinary temperatures of the aluminum alloys according to the present invention can stand comparison with that of the designation number 7075 high strength aluminum alloy (Sample No. 7). Thus, it has been demonstrated that the aluminum alloy according to the present invention is excellent in strength at ordinary temperatures and at high temperatures.

The Sample Nos. 8 and 9 aluminum alloys (Comparative Examples) whose Mn and Fe contents are less than those of the aluminum alloy of the present invention are slightly lower in strength at 200° C. as compared with the aluminum alloy of the present invention. The Sample Nos. 10, 11 and 12 aluminum alloys (Comparative Examples) whose Mn and Fe contents are more than those of the aluminum alloy of the present invention are degraded in strength as compared with the aluminum alloy of the present invention because coarsening and segregation of Mn compound unavoidably occurs at the cooling rate obtained by the atomization process. Thus, the Sample Nos. 8 to 12 aluminum alloys have been confirmed to be inferior as compared with the aluminum alloy according to the present invention.

As will be appreciated from the above discussion, the aluminum alloy according to the present invention is a light alloy material which is excellent in mechanical strength both at ordinary temperatures and at high temperatures as compared with conventional aluminum alloys, so that it is widely applicable, for example, in engine component parts which are required not only to be heat-resistant but also to be high in ordinary temperature strength, while achieving weight reduction of the component parts and an assembled product. Additionally, an article made of the aluminum alloy of the present invention can be produced with powder particles prepared by the atomization process, thus offering an advantage of omitting quench solidification such as troublesome splat cooling process.

What is claimed is:

1. A method for producing a heat-resisting light alloy article, consisting essentially of the steps of:

preparing a parent metal having a composition consisting essentially of manganese ranging from 6 to 8% by weight, greater than about 1% and less than or equal to about 2% by weight of iron, zirconium ranging from 0.03 to 0.5% by weight, copper ranging from 2 to 5% by weight, and the balance essentially aluminum;

superheating 150° C. over the melting point of said parent metal to obtain a superheated molten metal of said parent metal;

spraying said superheated molten metal to obtain atomized powder particles; and forming said powder particles into a predetermined shape.

2. A method as claimed in claim 1, further consisting essentially of the step of selecting powder particles having particle sizes smaller than 120 mesh after said spraying step.

3. A method as claimed in claim 2, wherein said forming step is carried out by compressing said powder particles under a pressure of about 3.5 tonf/cm$^2$.

4. A method as claimed in claim 3, further consisting essentially of the step of extruding said formed powder particles into a predetermined shape after said forming step.

5. A method as claimed in claim 4, wherein said extruding step is carried out at a temperature lower than 400° C.

6. A heat-resisting aluminum alloy consisting essentially of manganese ranging from 6 to 8% by weight, iron ranging from 1.5 to 2.0% by weight, zirconium ranging from 0.03 to 0.5% by weight, copper ranging from 2 to 5% by weight, and the balance essentially aluminum.

7. A material suitable for making an article by employing an atomization process in which molten parent metal of the material is atomized to obtain powder particles, said material consisting essentially of manganese ranging from 6 to 8% by weight, iron ranging from 1.5 to 2.0% by weight, zirconium ranging from 0.03 to 0.5% by weight, copper ranging from 2 to 5% by weight, and the balance essentially aluminum.

8. A component part of an automotive engine made of a material consisting essentially of manganese ranging from 6 to 8% by weight, iron ranging from 1.5 to 2.0% by weight, zirconium ranging from 0.03 to 0.5% by weight, copper ranging from 2 to 5% by weight, and the balance essentially aluminum.

9. A method for producing a heat-resisting light alloy article, consisting essentially of:

preparing a parent metal having a composition consisting essentially of manganese ranging from 6 to 8% by weight, an iron content of from 1.5 to 2.0% by weight, zirconium ranging from 0.03 to 0.5% by weight, copper ranging from 2 to 5% by weight, and the balance essentially aluminum;

melting said parent metal to obtain a molten metal of said parent metal;

spraying said molten metal to obtain atomized powder particles; and forming said powder particles into a predetermined shape.

* * * * *